United States Patent [19]

Sluijter

[11] Patent Number: 4,752,956

[45] Date of Patent: Jun. 21, 1988

[54] DIGITAL SPEECH CODER WITH BASEBAND RESIDUAL CODING

[75] Inventor: Robert J. Sluijter, Eindhoven, Netherlands

[73] Assignee: U.S. Philips Corporation, New York, N.Y.

[21] Appl. No.: 708,771

[22] Filed: Mar. 6, 1985

[30] Foreign Application Priority Data

Mar. 7, 1984 [NL] Netherlands ..... 8400728

[51] Int. Cl.[4] ..... G10L 5/00

[52] U.S. Cl. ..... 381/38; 381/47; 381/49

[58] Field of Search ..... 381/29–53

[56] References Cited

U.S. PATENT DOCUMENTS 4,133,976 1/1979 Atal et al. ..... 381/47

4,589,131 5/1986 Horvath et al. ..... 381/38

*Primary Examiner*—Emanuel S. Kemeny

*Attorney, Agent, or Firm*—Jack E. Haken; Emmanuel L. Lobato

[57] ABSTRACT

A digital speech coder of the baseband RELP-type (Residual-Excited Linear Prediction) comprises a transmitter (1) having an LPC-anaylser (10), a first adaptive inverse filter (11), a decimation lowpass filter (26) for selecting the baseband prediction residue and an encoding-and-multiplexing circuit (17), and a receiver (2) having a demultiplexing-and-decoding circuit (21), an interpolator (27) and a first adaptive synthesizing filter (14). The occurrence of "tonal noises" due to the spectral folding in interpolator (27) is effectively counteracted by arranging prior to the decimation lowpass filter (26) in the transmitter (1) a second adaptive inverse filter (28) which with the aid of an autocorrelator (31) removes possible periodicy from the speech band residue, and by including subsequent to the interpolator (27) in the receiver (2) a corresponding second adaptive synthesis filter (32), which reintroduces the desired periodicity in the excitation signal.

3 Claims, 4 Drawing Sheets a b

DIGITAL SPEECH CODER WITH BASEBAND RESIDUAL CODING

(A) BACKGROUND OF THE INVENTION

Figure 1:
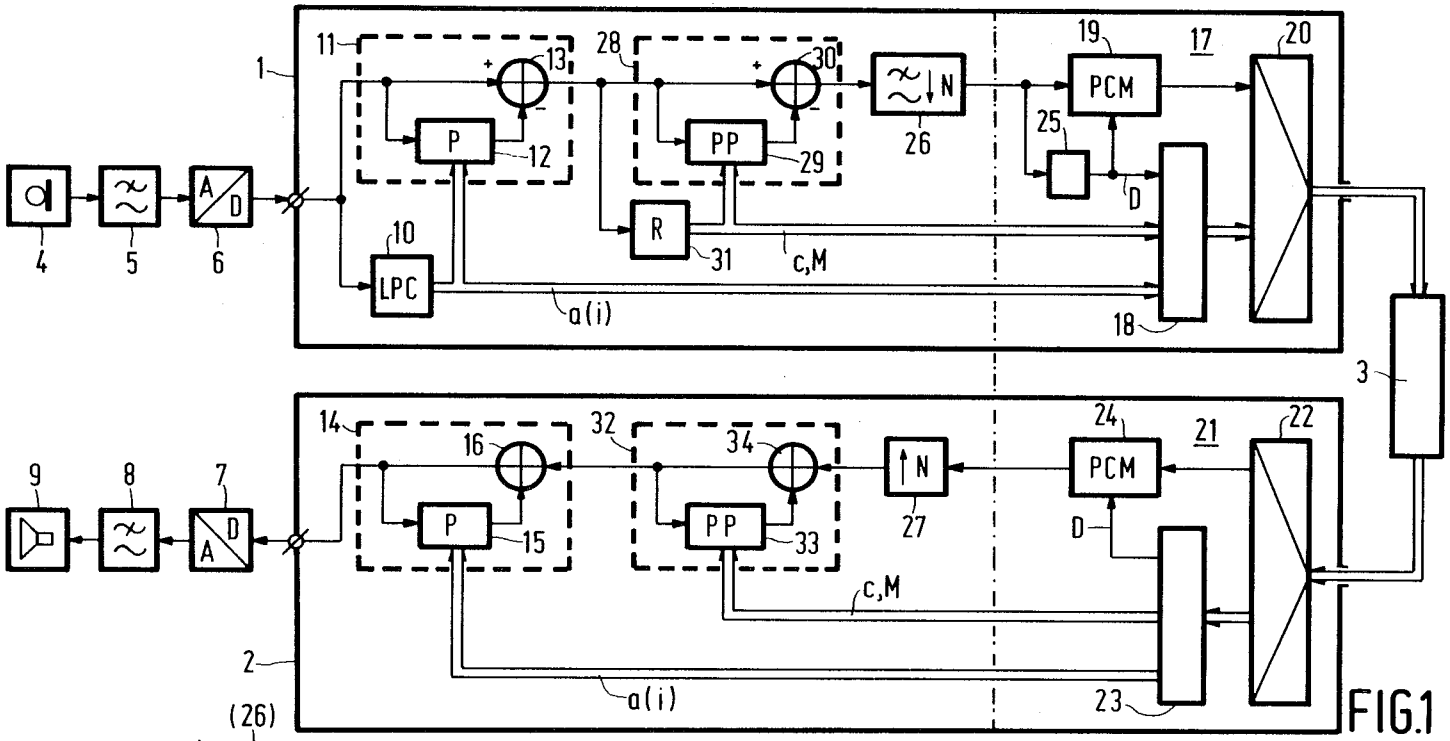

The invention relates to a digital speech coder comprising a transmitter and a receiver for transmitting segmented digital speech signals, the transmitter comprising:

- a first LPC-analyser for generating, in response to the digital speech signal of each segment, first prediction parameters which characterize the envelope of the segment-term spectrum of this digital speech signal,
- a first adaptive inverse filter for generating, in response to the digital speech signal of each segment and the first prediction parameters, a speech band residual signal which corresponds to the prediction error of this segment,
- a decimation filter for generating a baseband residual signal in response to the speech band residual signal, and
- an encoding-and-multiplexing circuit for encoding the first prediction parameters and the waveform of the baseband residual signal and for transmitting the resultant code signals in time-division-multiplex, and the receiver comprising:

- a demultiplexing-and-decoding circuit for separating the transmitted code signals and for decoding the separated code signals into the first prediction parameters and the waveform of the baseband residual signal,
- an interpolating excitation generator for generating, in response to the baseband residual signal, an excitation signal corresponding to the speech band residual signal, and
- a first adaptive synthetis filter for forming a replica of the digital speech signal in response to the excitation signal and the first prediction parameters.

Such a speech coder based on linear predictive coding (LPC) as a method of spectral analysis is known from the article by V. R. Viswanathan et al., "Design of a Robust Baseband LPC Coder for Speech Transmission over 9.6 Kbit/s Noisy Channels", IEEE Trans. Commun., Vol. COM-30, No. 4, April 1982, pages 663–673.

In this type of speech coder the digital speech signal is filtered with the aid of an inverse filter whose transfer function A(z) in z-transform notation is defined by $$A(z) = 1 - P(z) = 1 - \sum_{i=1}^{p} a(i)z^{-i}$$

where P(z) is the transfer function of a predictor based on a segment-term spectral envelope of the speech signal, the filter coefficients A(i) with $1 \leqq i \leqq p$ are the LPC-parameters computed for each speech signal segment of, for example, 20 ms and p is the LPC-order which usually has a value between 8 and 16. The speech band residual signal at the output of this inverse filter A(z) generally has a flat spectral envelope, which becomes the flatter according as the LPC-order p is higher. This speech band residual signal is used as an excitation signal for the (recursive) synthesis filter having the same filter coefficients a(i) and consequently a transfer function 1/A(z). As this synthesis filter 1/A(z) has a masking effect on the quantization noise of the speech band residual signal, it has been found that encoding the waveform of this residual signal with 3 bits per sample is adequate to obtain the same speech quality as in the case of a waveform encoding of the speech signal with the aid of a PCM coder standardized for telephony, in which the sampling rate is 8 kHz and an encoding with 8 bits per sample is used. The overall bit rate required for encoding the speech band residual signal and the LPC-parameters is however not significantly lower than in the case of a standardized PCM coder, as the speech band residual signal still has the same bandwidth as the speech band signal itself.

The speech coder described in the above-mentioned article utilizes the generally flat shape of the spectral envelope of the speech band residual signal to reduce the required overall bit rate. To that end the speech band residual signal is applied to applied to a digital low-pass filter, in which also a reduction of the sampling rate (decimation of down sampling) by a factor N of 2 to 8 is effected. In order to re-obtain a satisfactory excitation signal for the synthesis filter 1/A(z), the missing high-frequency portion of the spectrum must be recovered from the available low-frequency portion, the baseband, and in addition the sampling rate must be increased (interpolation or up sampling) to the original value. An excitation signal having the bandwidth of the actual speech signal is obtained in the prior art speech coder with the aid of a spectral folding method. With spectral folding the interpolation is merely the insertion of N−1 zero-value samples after every sample of the baseband residual signal, where N is the decimation factor. Consequently, the spectrum of the excitation signal consists of a low-frequency portion constituted by the preserved baseband and a high-frequency portion constituted by folding products of the baseband around the decimated sampling frequency and integral multiples thereof. This method has the advantage that a baseband residual signal having a flat spectral envelope results without fail in an excitation signal which also has a flat spectral envelope over the complete speech band. This property finds direct expression in the good speech quality thus obtained, the "hoarseness"—which is typical of the well-known non-linear distortion methods for obtaining an excitation signal having the bandwidth of the actual speech signal—is now absent.

So spectral folding is a very simple method which, however, has an inherent problem: it produces audible "metalic" background sounds which in the literature are known as "tonal noises" and which increase according as the decimation factor N is higher and according as the pitch of the speech is higher.

In view of this problem, a variant of the spectral folding method is applied in the excitation generator of the prior art speech coder, according to which the samples of the excitation signal are moreover subjected to a time-position perturbation after interpolation. More specifically, the time position of a nonzero-value sample (so an original sample of the baseband residual signal prior to interpolation) is randomly perturbed, and that by simply interchanging this nonzero sample with an adjacent zero-value sample if the magnitude of this nonzero sample remains below a predetermined threshold, the probability of perturbation increasing according as the magnitude of this nonzero sample is smaller. On the one hand the nonperturbed excitation signal is applied to a lowpass filter for selecting the baseband and on the other hand the perturbed excitation signal is applied to a highpass filter for selecting the high-frequency portion above the baseband, whereafter the two selected signals are added together to obtain the ultimate excitation signal. This variant of the spectral folding method essentially adds a signal-correlated noise to the spectrally folded baseband residual signal. From the perceptual point of view it was found that this additive noise has indeed a masking effect on the "tonal noises", but that it also introduces some "hoarseness". So using this variant in the prior art speech coder implicates a significant additional complication for the practical implementation, but does not result in a satisfactory solution of the "tonal noise" problem for spectral folding as a method of obtaining an excitation signal having the same bandwidth as the speech signal.

(B) SUMMARY OF THE INVENTION

The invention has for its object to provide a digital speech coder of the type set forth in the preamble of paragraph (A), which effectively counteracts the occurrence of "tonal noise" and results in a comparatively simple practical implementation.

According to the invention, the digital speech coder is characterized in that the transmitter further comprises:

- a second LPC analyser for generating, in response to the speech band residual signal of the first adaptive inverse filter, second prediction parameters which characterize the fine structure of the short-term spectrum of this speech band residual signal,
- a second adaptive inverse filter for generating, in response to the speech band residual signal and the second prediction parameters, a modified speech band residual signal which is applied to the decimation filter; the encoding-and-multiplexing circuit in the transmitter and the demultiplexing-and-decoding circuit in the receiver are arranged for processing both the first and the second prediction parameters; and the receiver further comprises:

- a second adaptive synthesis filter for forming, in response to the excitation signal of the interpolating excitation generator and the second prediction parameters, a modified excitation signal which is applied to the first adaptive synthesis filter.

The measures according to the invention are based on the recognition that the "tonal noises" which predominantly occur in periodic (voiced) speech fragments are in essence caused by the inharmonic relationship between the speech frequency components of the different spectrally folded versions of the baseband residual signal, but that for non-periodic (unvoiced) speech fragments no perceptually unwanted effects are produced by the spectral folding. In the speech coder according to the invention the speech band residual signal is freed from possible periodicity and consequently from harmonically-located speech frequency components with the aid of a second adaptive inverse filter. Consequently, both decimation in the transmitter and spectral folding effected by simple interpolation in the receiver are performed on signals which always have a pronounced non-periodic character so that the occurrence of "tonal noise" is effectively counteracted. Not until the spectral folding operation has been effected, the desired periodicity is again introduced into the speech band excitation signal with the aid of a second adaptive synthesis filter which is the counterpart of the second adaptive inverse filter.

In connection with the measures according to the invention mention is made of the fact that the prior art speech coder utilizes adaptive predictive coding (APC) for the transmission of the baseband residual signal, cf. FIG. 6 of the article mentioned in paragraph (A). The APC-coder uses a noise-feedback configuration and comprises an input filter in the form of an adaptive inverse filter whose adaptation is effected in response to the location and the value of the maximum autocorrelation coefficient of the input signal for delays exceeding 2 ms and the APC decoder comprises an adaptive synthesis filter which is the counterpart of the adaptive inverse filter in the APC-coder. Although the input signal of the APC-coder is freed from possible periodicity, which is reintroduced into the output signal of the APC-decoder, the occurrence of "tonal noises" in the prior art speech coder is not counteracted by these measures. In fact, the reintroduction of the periodicity is effected previous to the interpolation and consequently the spectral folding produces "tonal noise" which is not removed but only masked by the further measures in the prior art speech coder, some "hoarseness" furthermore occurring as a side effect. It is therefore essential to the present invention that the second adaptive inverse filtering operation takes place previous to decimation and the corresponding second adaptive synthesis filtering occurs after the spectral folding which is effected by simple interpolation.

(C) SHORT DESCRIPTION OF THE DRAWINGS

Figure 2:
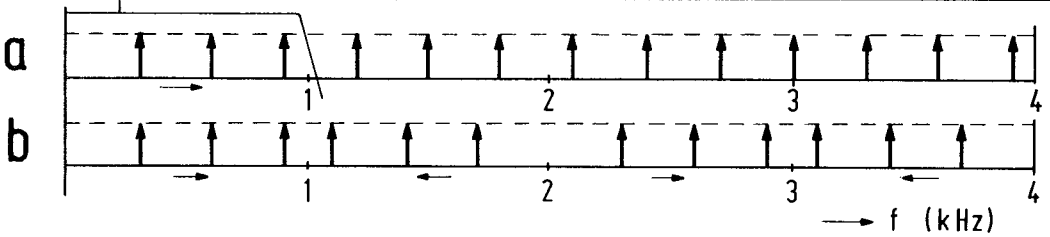
Figure 3:
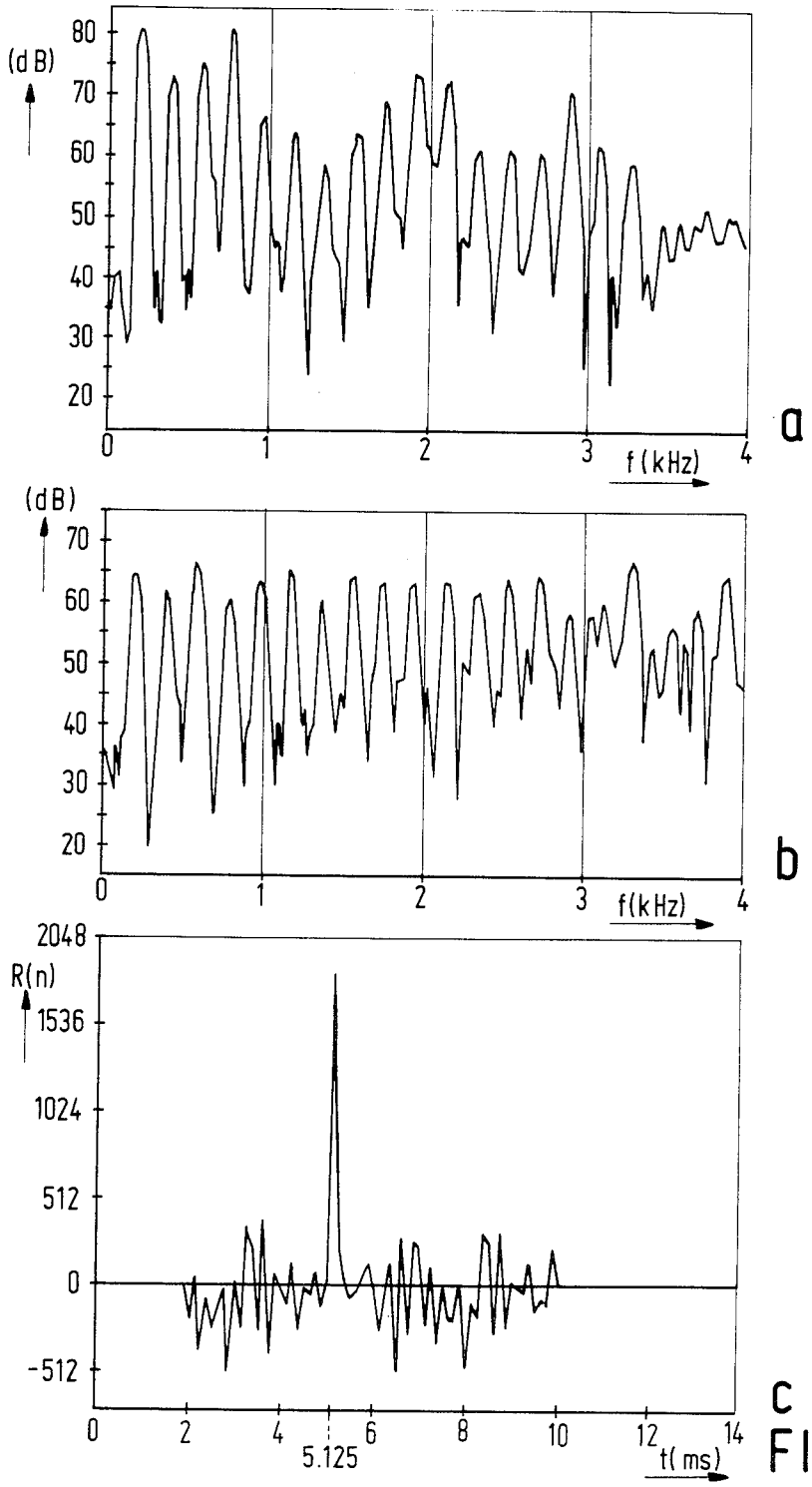
Figure 4:
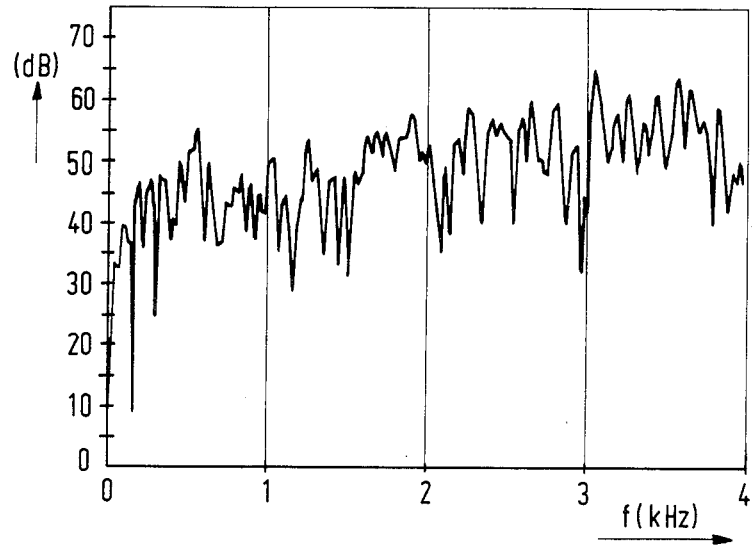
Figure 4:
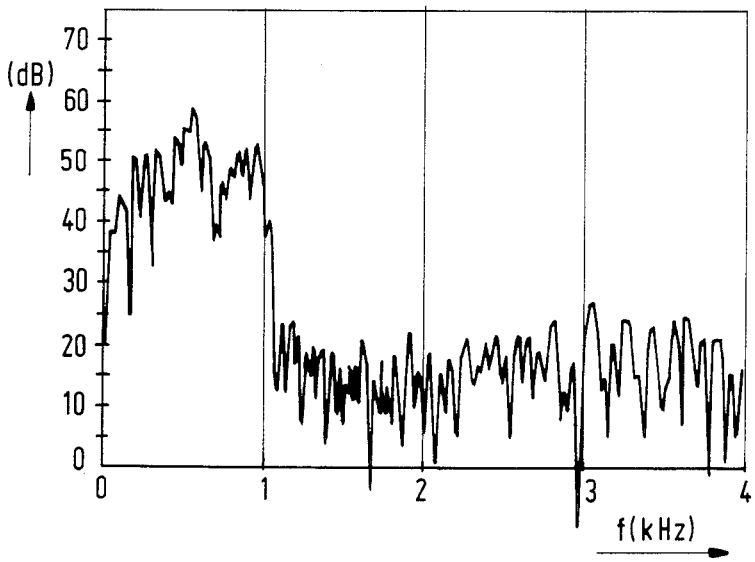
Figure 5:
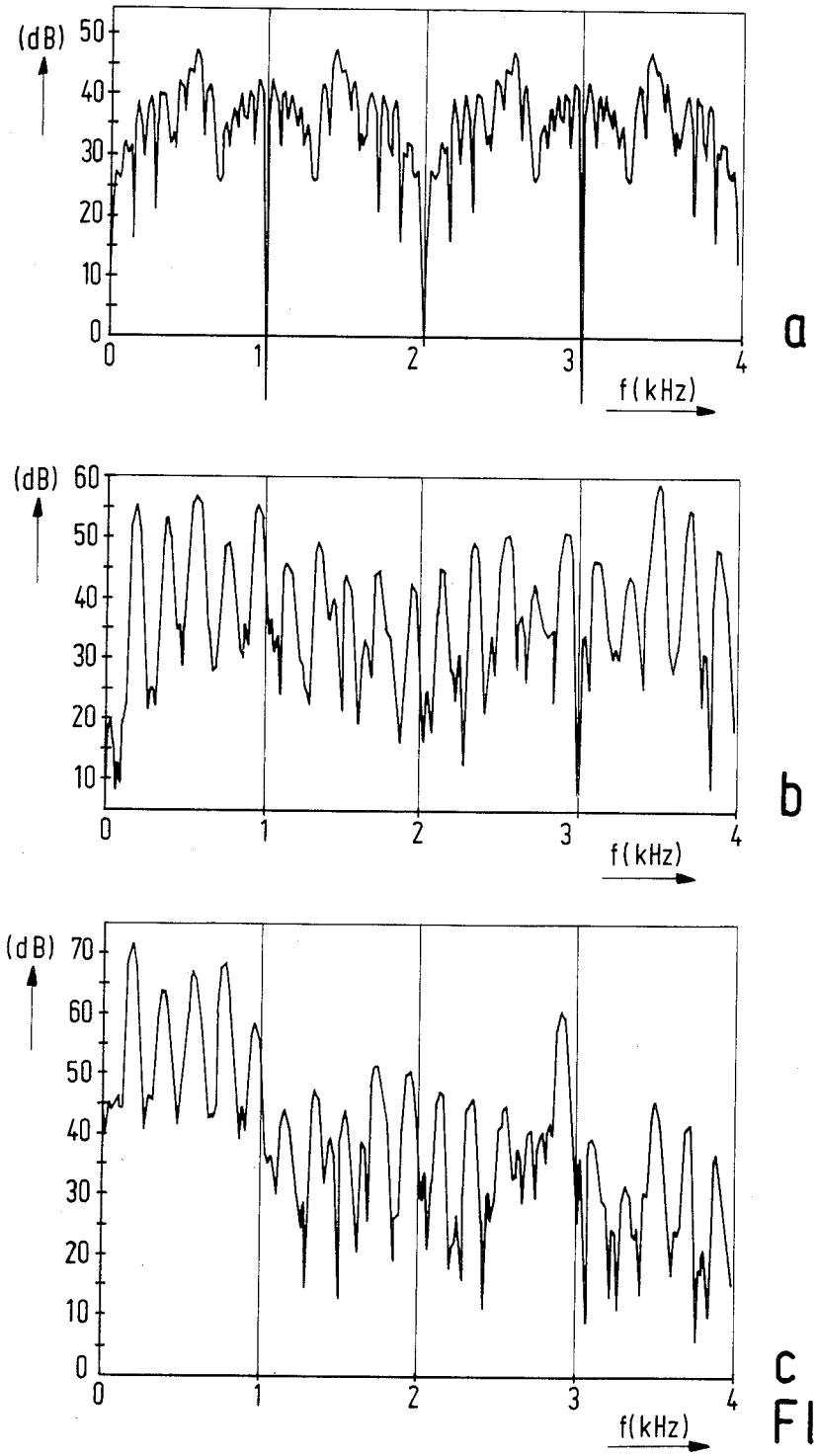

Particulars and advantages of the speech coder according to the invention will now be described in greater detail on the basis of an exemplary embodiment with reference to the accompanying drawings, in which:

FIG. 1 shows a block diagram of a digital speech coder according to the invention, FIG. 2 shows two frequency diagrams to explain the spectral folding method, FIG. 3, FIG. 4 and FIG. 5 show a number of amplitude spectra and an autocorrelation function of signals in different points of the speech coder of FIG. 1 which all relate to the same segment of the speech signal.

(D) DESCRIPTION OF AN EMBODIMENT

FIG. 1 shows a functional block diagram of a digital speech coder comprising a transmitter 1 and a receiver 2 for transmitting a digital speech signal through a channel 3 whose transmission capacity is significantly lower than the value of 64 kbit/s of a standard PCM-channel for telephony.

This digital speech signal represents an analog speech signal originating from a source 4 having a microphone or some other type of electro-acoustic transducer, and being limited to a 0–4 kHz speech band with the aid of a lowpass filter 5. This analog speech signal is sampled at a sampling rate of 8 kHz and converted into a digital code suitable for use in transmitter 1 by means of an analog-to-digital converter 6 which also divides this digital speech signal into overlapping segments of 30 ms (240 samples) which are renewed every 20 ms. In transmitter 1 this digital speech signal is processed into a signal which can be transmitted through channel 3 to receiver 2 and can be processed therein into a replica of this digital speech signal. By means of a digital-to-analog converter 7 this replica of the digital speech signal is converted into an analog speech signal which, after limitation to the 0–4 kHz speech band in a lowpass filter 8, is applied to a reproducing circuit 9 comprising a loudspeaker or another type of electro-acoustic transducer.

The speech coder shown in FIG. 1 belongs to the class of hybrid coders which in the literature are denoted as RELP-coders (Residual-Excited-Linear-Prediction). The basic structure of a RELP-coder will now first be described with reference to FIG. 1.

In transmitter 1, the segments of the digital speech signal are applied to an LPC-analyser 10, in which the LPC-parameters of a 30 ms speech segment are computed in known manner every 20 ms, for example on the basis of the auto-correlation method of the covariant method of linear prediction (cf. R. W. Schafer, J. D. Markel. "Speech Analysis", IEEE Press, New York, 1978, pages 124–143). The digital speech signal is also applied to an adaptive filter 11 comprising a predictor 12 and a subtractor 13. Predictor 12 is a transversal filter whose coefficients a(i) $1 \leqq i \leqq p$ are the LPC-parameters computed in analyser 10, the LPC-order p usually having a value between 8 and 16. In z-transform notation the transfer function p(z) of predictor 12 is given by:

$$P(z) = \sum_{i=1}^{p} a(i)z^{-i} \tag{1}$$

and the transfer function A(z) of filter 11 is given by:

$$A(z) = 1 - P(z) \tag{2}$$

The LPC-parameters a(i) are determined such that the output signal of filter 11, the speech band (prediction) residual signal, has a flattest possible segment-term (30 ms) spectral envelope. For this reason filter 11 is known in the literature as an inverse filter.

In the basic concept of a RELP-coder, the LPC-parameters a(i) and the waveform of the speech band residual signal are transmitted from transmitter 1 to receiver 2. In receiver 2 the transmitted speech band residual signal is used as an excitation signal for an adaptive synthesis filter 14 comprising a predictor 15 and an adder 16 in a recursive configuration. Predictor 15 is also a transversal filter having as coefficients the transmitted LPC-parameters a(i), so that the transfer function of predictor 15 is also given by formula (1) and the transfer function of synthesizing filter 14 by:

$$1/[1 - P(z)] = 1/A(z) \tag{3}$$

In the ideal case of a perfectly distortion-free transmission and perfectly stationary speech signals assumed here, the two filters 11 and 14 are accurately inverse to each other so that the original digital speech signal at the input of transmitter 1 is recovered at the output of synthesis filter 14 in the receiver. Since speech signals may only be considered as being locally stationary and consequently the LPC-parameters a(i) for both predictors 12, 15 must be renewed every 20 ms, this assumption only holds to a first approximation, but also then it has been found that in the case of a perfectly distortion-free transmission there is no perceptual difference between the original analog speech signal at the output of filter 5 in transmitter 1 and the replicated analog speech signal at the output of filter 8 in receiver 2.

In practice, the digital transmission of the LPC-parameters a(i) and the waveform of the speech band residual signal requires a quantization and an encoding operation. To that end, transmitter 1 comprises an encoding-and-multiplexing circuit 17 having a parameter encoder 18, an adaptive waveform encoder 19 and a multiplexer 20 for combining the resultant code signals into a time-division multiplex signal. Receiver 2 comprises a corresponding demultiplexing-and-decoding circuit 21 comprising a demultiplexer 22 for separating the time-division multiplex transmitted code signals, a parameter decoder 23 and an adaptive waveform decoder 24.

As is known, for the transmission of the LPC-parameters a(i) it is preferred to utilize "log-area-ratio" (LAR) coefficients g(i) which are obtained by first converting the LPC-parameters a(i) into reflection coefficients k(i) and to apply thereafter the following logarithmic transform:

$$g(i) = \log[1 + k(i)]/[1 - k(i)], \quad 1 \leqq i \leqq p \tag{4}$$

These LAR-coefficients g(i) are uniformly quantized and encoded every 20 ms, the total number of bits being allocated optimally to the different LAR-coefficients g(i) in accordance with a known method of minimizing the maximum spectral error in the replicated digital speech band (cf. V. R. Viswanathan, J. Mahoul, "Quantization Properties of Transmission Parameters in Linear Predictive Systems", IEEE Trans. Acoust., Speech, Signal Processing, Vol. ASSP-23, No. 3, June 1975, pages 309–321). When every 20 ms a total of, for example, 64 bits are available in parameter encoder 18 for the transmission of 16 LPC-parameters a(i) and consequently the LPC-order is p=16, then the following bit allocation for the LAR-coefficients g(i)–g(16) is used: 6 bits for g(1), g(2); 5 bits for g(3), g(4); 4 bits for g(5)–g(10); 3 bits for g(11)–g(16). The transmission capacity of channel 3 required for the LAR-coefficients then is 3.2 kbit/s. Since predictor 15 of synthesis filter 14 in receiver 2 utilizes LPC-parameters a(i) which were obtained from quantized LAR-coefficients g(i) with the aid of parameter decoder 23, predictor 12 of the inverse filter 11 in transmitter 1 must utilize the same quantized values of the LPC-parameters a(i).

In principle, each one of the known waveform encoding methods can be used for the transmission of the speech band residual signal. In FIG. 1 a simple adaptive PCM-method is opted for, according to which in transmitter 1 the maximum amplitude D of the speech band residual signal for each ms interval is determined with the aid of a maximum detector 25 and adaptive PCM-encoder 19 uniformly quantizes the samples of the speech band residual signal in a range (-D, +D). As synthesis filter 14 has a masking effect on the quantization noise, an encoding in 3 bits per sample is sufficient in PCM-encoder 19 to obtain a similar speech quality as in the case of the (logarithmic) PCM which has already been standardized for public telephony for many years and which utilizes an encoding in 8 bits per sample. In parameter encoder 18, the maximum amplitude D is logarithmically encoded in 6 bits, spanning a dynamic range of 64 dB. After decoding in parameter decoder 23, this maximum amplitude D is used in receiver 2 for controlling the adaptive PCM-decoder 24. The capacity of transmission channel 3 required for the speech band residual signal then is 24.3 kbit/s.

On multiplexing the code signals for the 16 LAR-coefficients (3.2 kbit/s) and for the speech band residual signal (24.3 kbit/s), two further bits are added by multiplexer 20 to the 20 ms frame of the time-division-multiplex signal for synchronizing demultiplexer 22, so that the described basic concept of a RELP-encoder requires a transmission channel 3 having an overall capacity of 27.6 kbit/s. This value means indeed an important improvement compared to the value of 64 kbit/s for the standardized PCM, but when compared with adaptive differential PCM (ADPCM) which is now being considered as a possible new standard for public telephony and which requires only a transmission capacity of 32 kbit/s, this improvement cannot be considered to be a significant improvement.

From the described example it will be evident that in the basic concept of a RELP-encoder by far the largest portion (88%) of the capacity of channel 3 is used for the transmission of a residual signal in the speech band from 0–4 kHz, that is to say with a bandwidth equal to the bandwidth of the actual speech signal to be transmitted. A significant reduction of this transmission capacity can now be accomplished by utilizing the fact that this speech band residual signal has a generally flat spectral envelope.

The method used therefore is known (cf. the article mentioned in paragraph (A) and consists in selecting a baseband of, for example, 0–1 kHz from the speech band residual signal at the output of inverse filter 11 in transmitter 1 and in similarly reducing the 8 kHz sampling rate by a decimation factor N=4 to a sampling rate of 2 kHz. In practice, both signal processing operations are effected in combination in a digital decimation lowpass filter 26. The baseband residual signal thus obtained is applied to adaptive PCM-encoder 19 and encoded there in the same way as the speech band residual signal in the basic form of the RELP coder. Thanks to the decimation of the sampling rate to a value of 2 kHz, the transmission capacity of channel 3 required for the baseband residual signal is however significantly lower and this capacity is now only 6.3 kbit/s. The transmission of the 16 LAR coefficients and the 2 frame synchronizing bits being unchanged, this baseband version of a RELP-coder requires a transmission channel 3 having an overall capacity of 9.6 kbit/s, a value which may indeed be considered to be significantly lower than the 64 kbit/s capacity required for a standard PCM-channel.

So as to obtain in receiver 2 an adequate excitation signal for synthesis filter 14, the missing high-frequency portion in the 1–4 kHz band must be recovered from the available transmitted baseband residual signal and in addition the decimated sampling rate of 2 kHz must be increased by a factor N=4 to the original value of 8 kHz. To this end use is made in receiver 2 of a spectral folding method, the excitation signal generator effecting these two signal processing operations being merely a simple interpolator 27 which inserts N−1=3 zero-value samples after every sample of the transmitted baseband residual signal. Consequently, the excitation signal at the output of interpolator 27 has not only the original sampling rate of 8 kHz, but has also a spectrum whose low-frequency portion is formed by the preserved 0–1 kHz baseband and whose high-frequency portion above 1 kHz is formed by the folding products of this baseband around the decimated sampling rate of 2 kHz and around integral multiples thereof. An important advantage of these spectral folding methods is that the excitation signal has a generally flat spectral envelope over the entire 0–4 kHz speech band. This property is directly recognizable from the good quality of the analog speech signals thus obtained, the "hoarseness" typical of non-linear distortion methods for obtaining an adequate excitation signal, now being absent.

However, the spectral folding was found to produce audible "metalic" background sounds which are known as "tonal noises" and which increase according as the decimation factor N is higher and according as the fundamental tone (pitch) of the speech is higher.

From extensive investigations into the causes of this "tonal noise", Applicants have come to the recognition that the "tonal noises" occurring predominantly in periodic (voiced) speech fragments are in essence caused by the inharmonic relationship between the speech frequency components of the different spectrally folded versions of the baseband residual signal. For non-periodic (unvoiced) speech fragments, the spectral folding causes in contrast thereto no perceptually unwanted effects. The disturbance of the harmonic relationship by spectral folding is illustrated in FIG. 2. Therein frequency diagram a shows an example of the spectrum of a periodic speech band residual signal with a flat spectral envelope, represented by a dotted line, and having a fundamental tone (pitch) of 300 Hz. Selecting the 0–1 kHz baseband and the components located therein at 300, 600 and 900 Hz with the aid of decimation lowpass filter 26 and spectral folding with the aid of interpolator 27 then results in an excitation signal having a spectrum as shown in frequency diagram b. The excitation signal indeed has also a flat spectral envelope in frequency diagram b, but the components of the spectrally folded versions in the respective bands of 1–2 kHz, 2–3 kHz and 3–4 kHz no longer have a harmonic relationship, both relative to each other and also relative to the components in the (preserved) 0–1 kHz baseband.

The fact that the "tonal noises" were found to increase with an increasing decimation factor N and an increasing fundamental tone frequency (pitch), underlines that precisely the inharmonic extension of the baseband residual signal (which itself is indeed harmonic at periodic speech fragments) must in essence be assumed to be responsable for the occurrence of the "tonal noises", as an increasing decimation factor and an increasing fundamental tone frequency are generally accompanied by an increasing disturbance of the originally harmonic relationship between the components of a periodical speech band residual signal.

Now, according to the invention, the speech band residual signal at the output of inverse filter 11 and transmitter 1 is freed of possible periodicity and so of harmonically located components with the aid of a second adaptive inverse filter 28 comprising a predictor 29 and a subtractor 30. Predictor 29 is also a transversal filter whose coefficients are second LPC-parameters, which are calculated every 20 ms in a second LPC-analyser 31 and characterize the fine structure of the short-term (20 ms) spectrum of the speech band residual signal. Without essential loss in efficacy it is sufficient to provide a predictor 29 of which nearly all the coefficients are adjusted to zero value and only very few coefficients, or even only one coefficient, have a value unequal to zero. For the sake of simplicity, a predictor 29 having one coefficient should be preferred, the more so as using more coefficients, for example 3 or 5, was found to result in only very marginal improvements. In the embodiment described predictor 29 is therefore a transversal filter having only one coefficient c and a transfer function PP(z) which in z-transform notation is given by:

$$PP(z)=cz^{-M} \tag{5}$$

where M is the fundamental interval of the periodicity, expressed in the number of samples of the speech band residual signal. The two second prediction parameters c and M are obtained with the aid of a simple second LPC-analyser in the form of an autocorrelator 31 which computes the autocorrelation function R(n) of each 20 ms interval of the speech band residual signal for delays ("lags"), expressed in the number n of the samples, exceeding the LPC-order p of analyser 10, and which further determines M as the location of the maximum of R(n) for n>p and c as the ratio R(M)/R(O). This second adaptive inverse filter 28 has a transfer function AA(z) given by:

$$AA(z)=1-PP(z)\geqq 1-c\,z^{-M} \tag{6}$$

Then a modified speech band residual signal having a pronounced non-periodic character for both unvoiced and voiced speech fragments is produced at the output of filter 28. In receiver 2 the desired periodicity is not introduced into the excitation signal until after the spectral folding operation with the aid of interpolator 27 has been completed and this introduction is effected with the aid of a second adaptive synthetis filter 32, which is the counterpart of second inverse filter 28 in transmitter 1 and comprises a predictor 33 and an adder 24 in a recursive configuration. So the transfer function of predictor 33 is also given by formula (5) and the transfer function of this second adaptive synthesis filter 32 is given by:

$$1/[1-PP(z)]=1/AA(z) \tag{7}$$

A modified excitation signal with the desired harmonic relationship between the periodic components over the entire 0–4 kHz speech band then occurs at the output of this second adaptive, synthesis filter 32, this modified excitation signal being applied to the first adaptive synthesis filter 14. Thanks to these measures both the decimation lowpass filtering in transmitter 1 for obtaining a baseband residual signal and also the spectral folding in receiver 2 effected by interpolation for obtaining an excitation signal, are performed on signals which, in essence, are always free from periodicity, so that the production of "tonal noises" on spectral folding is effectively counteracted.

For non-periodic speech signals such as unvoiced speech fragments or speech pauses, the maximum autocorrelation coefficient R(M) is so low and consequently the value of prediction parameter $c=R(M)/R(O)$ is so small, that the speech band residual signal passes the second inverse filter 28 substantially without modification. For periodic speech signals such as voiced speech fragments the periodicity of the speech band residual signal is predominantly determined by the fundamental frequency (pitch). Now the highest fundamental tone frequencies occurring in speech always have a value less than 500 Hz and consequently a period exceeding 2 ms, while for values below 100 Hz, so fundamental tone periods exceeding 10 ms, no audible "tonal noise" is perceived. For the practical implementation of autocorrelator 31 this implicates that the autocorrelation function R(n) must only be computed in the interval from 2 ms to 10 ms, so for values n with $17\leqq n\leqq 80$ at sampling rate of 8 kHz, which results in a significant savings in computing efforts. More specifically, R(n) is computed in accordance with the formula $$R(n)=\sum_{r=0}^{159-n} b(r)\cdot b(r+n),\ 17\leqq n\leqq 80 \tag{8}$$

where b(r) with r=0, 1, 2, . . . , 159 represent the samples of the speech band residual signal in the 20 ms interval. The value of R(n) for n=0, so:

$$R(0)=\sum_{r=0}^{159} b^2(r) \tag{9}$$

is normalized to R(O)=2048 so that the prediction parameter c is given by:

$$C=R(M)/2048 \tag{10}$$

As for M it holds that $17\leqq M\leqq 80$, the value of M can be encoded in 6 bits. In practice a quantization of the value of c in 4 bits is sufficient. This encoding operation of the second prediction parameters c and M must be effected every 20 ms, for which purpose parameter encoder 18 in transmitter 1 and parameter decoder 23 in receiver 2 are arranged such that both the LPC-parameters a(i) with $1\leqq i\leqq p$ and also the second prediction parameter c, M are processed. As predictor 33 of synthesis filter 32 in receiver 2 utilizes a quantized prediction parameter c, predictor 29 of inverse filter 28 in transmitter 1 must utilize the same quantized value of c.

Because of the effective removal of "tonal noise" it is possible to use a lower LPC-order p than for the above-described baseband version of a RELP-coder, where p=16. If, for example, an LPC-order p=12 is chosen, only 12 LAR-coefficients g(i) need to be transmitted. With a same overall capacity of 9.6 kbit/s for transmission channel 3, the capacity of 600 bit/s which was originally reserved for the transmission of LAR-coefficients g(13)–g(16) can be used for transmitting the second prediction parameters c and M, for which a capacity of 500 bit/s is required in the described example. The remaining capacity of 100 bit/s can then be used to apply two additional bits to the 20 ms frame of the time-division-multiplex signal for synchronizing demultiplexer 21, so that now in each 192-bit frame 4 bits are used for frame synchronization, which increases the reliability of the transmission.

For a further explanation of the mode of operation of the digital speech encoder according to the invention, FIG. 3, FIG. 4 and FIG. 5 show a number of amplitude spectra and an autocorrelation function of signals in different points of the coder of FIG. 1 which all relate to the same 30 ms voiced speech segment. The dB values plotted along the vertical axis are then always related to a same, but arbitrarily selected, reference value.

Diagram a in FIG. 3 shows the amplitude spectrum of the speech segments at the output of analog-to-digital converter 6 and diagram b shows the amplitude spectrum of the speech band residual signal at the output of first inverse filter 11. Diagram b of FIG. 3 shows that this speech band residual signal has a substantially flat spectral envelope and that a clear periodicity is present which corresponds to a fundamental tone (pitch) of approximately 195 Hz. Diagram c of FIG. 3 shows the autocorrelation function R(n) of this speech band residual signal normalized to a value R(O)=2048 and only computed in autocorrelator 31 for the sub-interval from 2 ms to 10 ms within the 20 ms interval. The peak of R(n) occurs for a value of 5.125 ms, which corresponds to a value M=41 and a fundamental tone (pitch) of approximately 195 Hz, and the coefficient c=R(M)/2048 has a value of approximately 0.882, which is quantized to a value c=0.875. In FIG. 4 diagram a illustrates the amplitude spectrum of the modified speech band residual signal at the output of second inverse filter 28, the values M=41 and c=0.875 being used in predictor 29. Comparing diagram a in FIG. 4 with diagram b in FIG. 3 clearly shows the suppression of the periodicity which corresponds to the fundamental tone (pitch) of approximately 195 Hz. Diagram b in FIG. 4 shows the amplitude spectrum of the baseband residual signal after low-pass filtering in filter 26 (but before the decimation with a factor of 4).

In FIG. 5 diagram a illustrates the amplitude spectrum of the excitation signal at the output of interpolator 27 obtained after the decimation operation on the baseband residual signal of diagram b in FIG. 4 has been effected, as well as the subsequent performance of the encoding, transmitting, decoding and interpolating (by adding samples having zero amplitude) operations. Diagram b in FIG. 5 shows the amplitude spectrum of the modified excitation signal at the output of second synthetis filter 32, from which it will be clear that the periodicity corresponding to the fundamental tone (pitch) of approximately 195 Hz is re-introduced and the correct harmonic relationship is present over the entire 0–4 kHz speech band. Finally, diagram c in FIG. 5 illustrates the amplitude spectrum of the replicated speech segment at the output of first synthesis filter 14.

Using the described measures results in a baseband version of a RELP-coder which has the following advantages:

The occurrence of "tonal noise" is effectively counteracted,

The baseband of the speech signal need not be processed separately since the present speech coder is wholly transparent for the baseband, in fact, from formulae (1)–(3) and (5)–(7) it follows that for the series arrangement of the respective first and second inverse filters 11,28 and second and first synthesis filters 32,14 it holds that:

$$A(z)\cdot AA(z)\cdot 1/AA(z)\cdot 1/A(z)=1 \qquad (11)$$

independent of the values of the prediction parameters a(i), c and M;

Second inverse filter 28 has a reducing effect on the dynamic range of the baseband residual signal to be transmitted so that that this signal becomes less sensitive to quantization.

In the case of random bit errors in transmission channel 3, the speech quality degrades only gradually with an increasing bit error rate until a breakpoint, the audibility rapidly decreasing for larger bit error rates. This breakpoint is approximately located at a bit error rate of 1% but by using error correction techniques this figure can be improved to the detriment of some increase in bit rate.

Transmitter 1 and receiver 2 can be implemented in a simple way with the aid of a plurality of customary digital signal processors, for example of the type NEC/μDP 7720, in a known parallel configuration in which the processor can communicate via an 8-bit wide data bus. The processors can communicate via the serial interfaces with external components such as the analog-to-digital and digital-to-analog converters 6, 8 and modems which form part of transmission channel 3. In addition, an input-output controller is associated with each processor for the traffic over the data bus. The microprograms for the controllers and the processors necessary for performing the different signal processing operations described in the foregoing, can be assembled by an average person skilled in the art utilizing the users' information the signal processor manufacturer supplies. In order to give an adequate impression of the complexity, it should be noted that the signal processor type NEC/μDP 7720 has a 28-pin casing and consumes approximately 1 Watt, and that an input-output controller comprises only some dozens of logic gates.

What is claimed is:

1. A digital speech coder comprising a transmitter and a receiver for transmitting segmented digital speech signals, the transmitter comprising:

a first LPC-analyser for generating, in response to the digital speech signal of each segment, first prediction parameters which characterize the envelope of the segment-term spectrum of this digital speech signal, a first adaptive inverse filter for generating, in response to the digital speech signal of each segment and the first prediction parameters, a speech band residual signal corresponding to the prediction error of this segment, a decimation filter for generating a baseband residual signal in response to the speech band residual signal, and an encoding-and-multiplexing circuit for encoding the first prediction parameters and the waveform of the baseband residual signal and for transmitting the resultant code signal in time-division-multiplex, and the receiver comprising:

a demultiplexing-and-decoding circuit for separating the transmitted code signals and for decoding the separated code signals into the first prediction parameters and the waveform of the baseband residual signal, an interpolating excitation generator for generating, in response to the baseband residual signal, an excitation signal corresponding to the speech band residual signal, and a first adaptive synthesis filter for forming a replica of the digital speech signal in response to the excitation signal and the first prediction parameters; characterized in that the transmitter further comprises;

a second LPC-analyser for generating, in response to the speech band residual signal of the first adaptive inverse filter, second prediction parameters which characterize the fine structure of the short-term spectrum of this speech band residual signal, a second adaptive inverse filter for generating, in response to the speech band residual signal and the second prediction parameters, a modified speech band residual signal which is applied to the decimation filter; the encoding-and-multiplexing circuit in the transmitter and the demultiplexing-and-decoding circuit in the receiver are arranged for processing both the first and the second prediction parameters; and the receiver further comprises:

a second adaptive synthesis filter for forming, in response to the excitation signal of the interpolating excitation generator at the second prediction parameters, a modified excitation signal which is applied to the first adaptive synthesis filter.

2. A digital speech coder as claimed in claim 1, characterized in that the second LPC-analyser is constituted by an autocorrelator for generating autocorrelation coefficients of the speech band residual signal and for selecting the location and the value of the maximum autocorrelation coefficient for delays exceeding the delay corresponding to the order of the first LPC-analyser.

3. A digital speech coder as claimed in claim 2, characterized in that the autocorrelator is arranged for generating autocorrelation coefficients only for delays in the time interval between 2 ms and 10 ms.

* * * * *